US012366402B2

(12) United States Patent
Ji et al.

(10) Patent No.: US 12,366,402 B2
(45) Date of Patent: Jul. 22, 2025

(54) CONTROL METHOD FOR REFRIGERATING AND FREEZING DEVICE, AND REFRIGERATING AND FREEZING DEVICE

(71) Applicants: QINGDAO HAIER SPECIAL REFRIGERATOR CO., LTD, Shandong (CN); QINGDAO HAIER REFRIGERATOR CO., LTD., Shandong (CN); HAIER SMART HOME CO., LTD., Shandong (CN)

(72) Inventors: Lisheng Ji, Qingdao (CN); Ming Wang, Qingdao (CN); Peng Li, Qingdao (CN); Zhiqiang Han, Qingdao (CN); Zhanpeng Cui, Qingdao (CN); Kai Wang, Qingdao (CN)

(73) Assignees: QINGDAO HATER SPECIAL REFRIGERATOR CO., LTD, Shandong (CN); QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 191 days.

(21) Appl. No.: 18/004,497

(22) PCT Filed: Jun. 29, 2021

(86) PCT No.: PCT/CN2021/103182
§ 371 (c)(1),
(2) Date: Jan. 6, 2023

(87) PCT Pub. No.: WO2021/219148
PCT Pub. Date: Nov. 4, 2021

(65) Prior Publication Data

US 2023/0251013 A1 Aug. 10, 2023

(30) Foreign Application Priority Data

Jul. 8, 2020 (CN) ..... 202010653066.6

(51) Int. Cl.
*F25D 17/06* (2006.01)
*F25D 11/02* (2006.01)

(52) U.S. Cl.
CPC ..... *F25D 17/065* (2013.01); *F25D 11/02* (2013.01); *F25D 2317/061* (2013.01)

(58) Field of Classification Search
CPC ..... F25D 11/02; F25D 17/045; F25D 17/042; F25D 17/065; F25D 21/12; F25D 2317/0413; F25D 2700/12; F25D 2317/061
See application file for complete search history.

(56) References Cited

U.S. PATENT DOCUMENTS

2012/0111047 A1 5/2012 Van Meter et al.
2013/0340868 A1* 12/2013 Park ..... F25D 17/047 137/565.23
2020/0393179 A1* 12/2020 Kim ..... F25D 11/022

FOREIGN PATENT DOCUMENTS

CN 1248691 A 3/2000
CN 101586898 A 11/2009
(Continued)

OTHER PUBLICATIONS

Partial Supplementary European Search Report for EP Patent Application No. 21795308.2 dated Oct. 27, 2023 (12 pages).
(Continued)

*Primary Examiner* — Frantz F Jules
*Assistant Examiner* — Martha Tadesse
(74) *Attorney, Agent, or Firm* — troutman pepper locke; Tim Tingkang Xia, Esq.

(57) ABSTRACT

A control method for a refrigerating and freezing device, and the refrigerating and freezing device are disclosed. The refrigerating and freezing device includes a storage compartment, a refrigeration compartment, and a refrigeration system at least partially arranged in the refrigeration compartment. The control method includes: controlling the
(Continued)

refrigeration system to stop supplying cold to the storage compartment; and connecting the refrigeration compartment with the storage compartment, and controlling a fan of the refrigeration system to operate so as to promote air in the refrigeration compartment and the storage compartment to flow circularly. In the present invention, air in the storage compartment is utilized to carry out air defrosting on the refrigeration compartment, and then the defrosted high-humidity gas is led back to the storage compartment.

9 Claims, 4 Drawing Sheets

(56) References Cited

FOREIGN PATENT DOCUMENTS

| | | | | | |
|---|---|---|---|---|---|
| CN | 106152670 | A | | 11/2016 | |
| CN | 206001774 | U | | 3/2017 | |
| CN | 106766537 | A | | 5/2017 | |
| CN | 106969594 | A | | 7/2017 | |
| CN | 111059841 | A | | 4/2020 | |
| EP | 2757334 | A1 | * | 7/2014 | ..... F25D 17/042 |
| JP | 2763622 | B2 | | 6/1998 | |
| JP | H10311649 | A | | 11/1998 | |
| JP | 2004-037042 | | | 2/2004 | |
| JP | 2017-026221 | A | | 2/2017 | |
| KR | 10-2014-0010827 | | | 1/2014 | |

OTHER PUBLICATIONS

1st Examination Report for Australia Patent Application No. 2021262372 dated Oct. 17, 2023 (3 pages)58.

1st Office Action for Japan Patent Application No. 2023-500359 dated Oct. 24, 2023 w/English machine translation (10 pages).

1st Office action for China Application No. 202010653066.6 dated Jul. 26, 2022 (8 pages).

International Search Report and Written Opinion for PCT/CN2021/103182 (ISA/CN) mailed Aug. 24, 2021 (8 pages).

* cited by examiner

CONTROL METHOD FOR REFRIGERATING AND FREEZING DEVICE, AND REFRIGERATING AND FREEZING DEVICE

CROSS-REFERENCE TO RELATED APPLICATIONS

The present application is a national phase entry of International Application No. PCT/CN2021/103182, filed Jun. 29, 2021, which claims priority to Chinese Application No. 202010653066.6, filed Jul. 8, 2020, which are each incorporated herein by reference in entirety.

FIELD OF THE INVENTION

The present invention relates to the field of refrigerating and freezing, and particularly relates to a control method for a refrigerating and freezing device, and the refrigerating and freezing device.

BACKGROUND OF THE INVENTION

Fruits and vegetables are common food stored in refrigerators. Both low temperature and high humidity are required for keeping fruits and vegetables fresh. In the prior art, a separate fresh-keeping area is defined in a refrigerator. The fresh-keeping area is humidified by means of defrosted water produced by heating an evaporator, which not only needs to arrange an additional heating device for heating, increasing the production cost, but also increases the energy consumption for daily use, resulting in energy waste. All things considered, there is a need for a low-cost control method for a refrigerating and freezing device with a fresh-keeping area, and the refrigerating and freezing device in devising.

BRIEF DESCRIPTION OF THE INVENTION

One objective of a first aspect of the present invention is to overcome at least one technical defect of the prior art and to provide a control method for a refrigerating and freezing device.

One further objective of the first aspect of the present invention is to reduce energy consumption.

Another further objective of the first aspect of the present invention is to avoid excessive frosting of a refrigeration compartment.

One objective of a second aspect of the present invention is to provide a refrigerating and freezing device.

According to the first aspect of the present invention, provided is a control method for a refrigerating and freezing device. The refrigerating and freezing device includes a storage compartment, a refrigeration compartment, and a refrigeration system at least partially arranged in the refrigeration compartment. The control method includes:

controlling the refrigeration system to stop supplying cold to the storage compartment; and connecting the refrigeration compartment with the storage compartment, and controlling a fan of the refrigeration system to operate so as to promote air in the refrigeration compartment and the storage compartment to flow circularly.

Optionally, the storage compartment is separated into a fresh-keeping area and a common storage area, wherein the step of connecting the refrigeration compartment with the storage compartment includes:

connecting the refrigeration compartment with the storage area; and connecting, after a first preset time, the refrigeration compartment with the storage area and the fresh-keeping area to humidify the fresh-keeping area.

Optionally, the control method also includes:

controlling the fan to stop operating and disconnecting the refrigeration compartment from the fresh-keeping area after performing the step of connecting the refrigeration compartment with the storage area and the fresh-keeping area for a second preset time; and disconnecting, after a third preset time, the refrigeration compartment from the storage area.

Optionally, before the step of controlling the refrigeration system to stop supplying cold to the storage compartment, the control method also includes:

controlling, when a storage temperature of the storage compartment is greater than or equal to a preset start-up temperature, the refrigeration system to supply cold to the storage compartment; and performing, when the storage temperature of the storage compartment decreases to be less than or equal to a preset shutdown temperature, the step of controlling the refrigeration system to stop supplying cold to the storage compartment.

Optionally, the storage compartment is separated into a fresh-keeping area and a common storage area, wherein the storage temperature of the storage compartment is the temperature of the storage area; and/or the storage temperature of the storage compartment is greater than 0° C.

Optionally, the storage compartment is separated into a fresh-keeping area and a common storage area, wherein while performing the step of controlling the refrigeration system to supply cold to the storage compartment, the method also includes:

connecting the refrigeration compartment with the storage area, and disconnecting the refrigeration compartment from the fresh-keeping area.

Optionally, the step of controlling the refrigeration system to stop supplying cold to the storage compartment is performed each time the storage temperature of the storage compartment decreases to be less than or equal to the preset shutdown temperature.

According to the second aspect of the present invention, provided is a refrigerating and freezing device, including:

a cabinet, defining a storage compartment and a refrigeration compartment;

a refrigeration system, at least partially arranged in the refrigeration compartment to supply cold to the storage compartment;

a processor; and a memory, storing a computer program which, when executed by the processor, is used to implement the control method according to any one of the embodiments of the present invention.

Optionally, the storage compartment is separated into a fresh-keeping area and a common storage area; and the fresh-keeping area is arranged below the storage area.

Optionally, the storage compartment is separated into a fresh-keeping area and a common storage area; and the fresh-keeping area is provided with a valve for keeping a gas pressure of the fresh-keeping area within a preset pressure threshold value.

In the present invention, air in the storage compartment is utilized to carry out air defrosting on the refrigeration compartment, and then the defrosted high-humidity gas is led back to the storage compartment; the conceptual limitation of the prior art of utilizing a heating device to generate liquid defrosted water and then carrying out humidification is broken through, and heat of the storage compartment is fully utilized to defrost the refrigeration compartment; and the air temperature after defrosting is more suitable, and more abundant humidity can be brought to the storage compartment, thereby reducing the production cost and energy consumption during use.

Further, in the present invention, the storage compartment is refrigerated before being humidified, so as to make the temperature of the storage compartment within an allowable fluctuating range, which ensures the storage quality of food in the storage compartment. Further, in the present invention, the storage compartment is humidified each time the storage compartment is refrigerated, which avoids excessive frosting of the storage compartment, thereby increasing the effective utilization rate of cold and making the humidity of the storage compartment more stable.

Further, in the humidifying process of the present invention, the refrigeration compartment is connected with the storage area first and then connected with the fresh-keeping area, and after humidifying the fresh-keeping area, the refrigeration compartment continues to be connected with the storage area, thereby effectively improving the humidity of the fresh-keeping area and keeping the humidity of the storage area stable, since the inventors of the present invention inventively recognize that defrosting the refrigeration compartment with air from the storage compartment will take away water vapor from the storage compartment in an initial stage (the water vapor condenses in the refrigeration compartment).

These and other objectives, advantages and features of the present invention will be better understood by those skilled in the art in the light of the detailed description of specific embodiments of the present invention in conjunction with the accompanying drawings below.

BRIEF DESCRIPTION OF THE DRAWINGS

Some specific embodiments of the present invention will be described below in detail in an exemplary rather than a limiting manner with reference to the accompanying drawings. Identical reference numerals in the accompanying drawings indicate identical or similar components or parts. It should be understood by those skilled in the art that these accompanying drawings are not necessarily drawn to scale. In the accompanying drawings.

DETAILED DESCRIPTION

Figure 1:
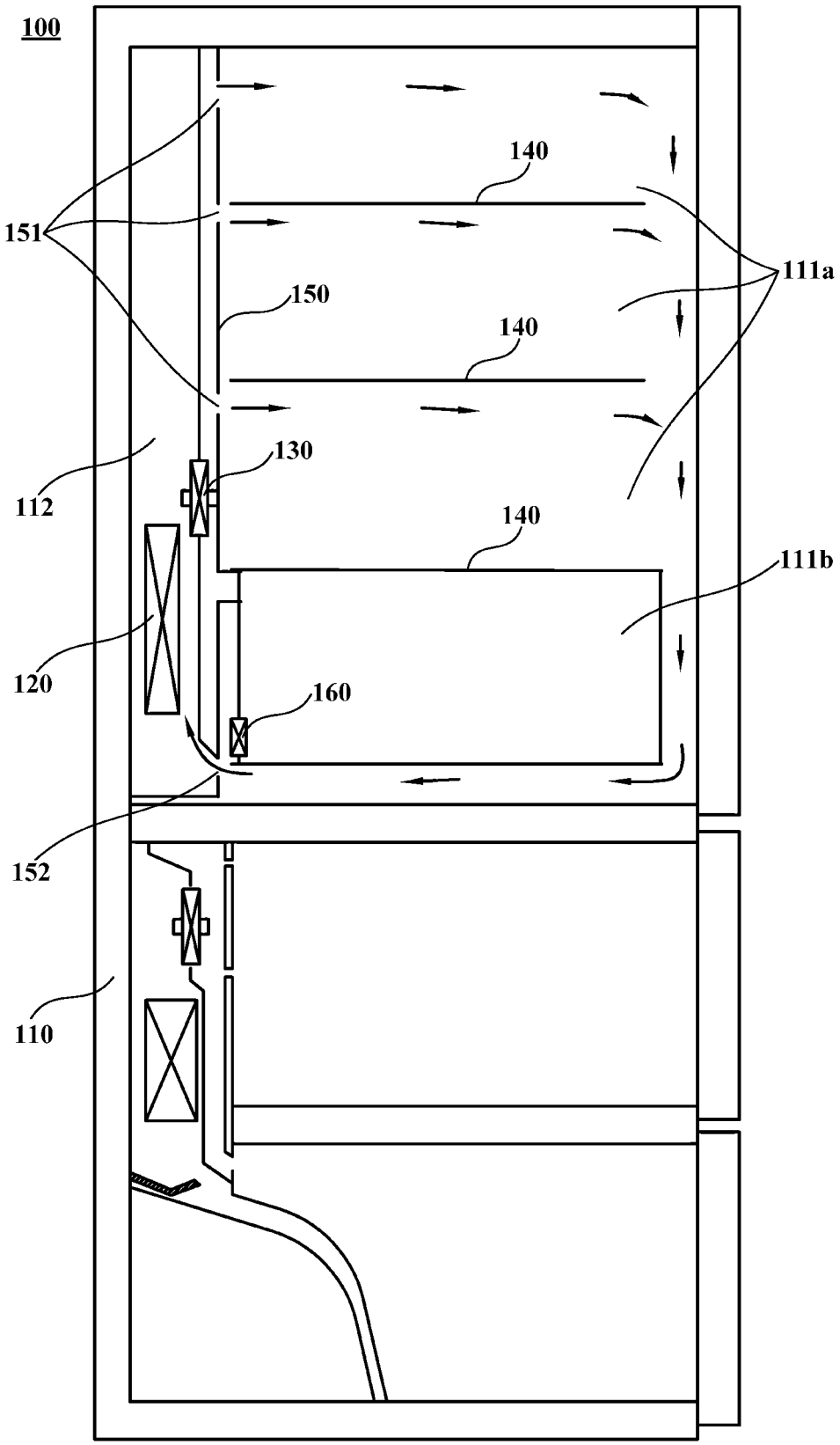
FIG. 1 is a schematic section view of a refrigerating and freezing device according to an embodiment of the present invention, showing a gas flow path that connects a refrigeration compartment with a storage area and disconnects the refrigeration compartment from a fresh-keeping area.

FIG. 1 is a schematic section view of a refrigerating and freezing device 100 according to an embodiment of the present invention, showing a gas flow path that connects a refrigeration compartment 112 with a storage area 111*a* and disconnects the refrigeration compartment 112 from a fresh-keeping area 111*b*. Referring to FIG. 1, the refrigerating and freezing device 100 may include a cabinet 110, a refrigeration system, a processor and a memory (the processor and the memory are not shown in FIG. 1).

The cabinet 110 may include an outer container, at least one inner liner, and a thermal insulating layer arranged between the outer container and the inner liner. The cabinet 110 may define at least one storage compartment and at least one refrigeration compartment 112. In the illustrated embodiment, there are two inner liners, two storage compartments and two refrigeration compartments 112. Each of the inner liners defines a storage compartment and a refrigeration compartment 112, and the storage compartment and the refrigeration compartment 112 may be separated by an air duct cover plate 150.

In some other embodiments, there may be a plurality of storage compartments, and there may be one refrigeration compartment 112. The storage compartments and the refrigeration compartment 112 may be independent of each other and separated by thermal insulating layers. The refrigeration compartment 112 may also be arranged in one inner liner together with one of the storage compartments.

The refrigeration system may be a vapor compression refrigeration system, including a compressor, a condenser, a throttling element, an evaporator 120 and an air supply fan 130. The refrigeration system (e.g., the evaporator 120 and the air supply fan 130) may be at least partially arranged in the refrigeration compartment 112 to supply cold to the storage compartment.

The memory may store a computer program which, when executed by the processor, is used to implement the control method of the present invention.

Particularly, the processor may be configured to control the refrigeration system to stop supplying cold to the storage compartment, connect the refrigeration compartment 112 with the storage compartment, and control the fan 130 of the refrigeration system to operate so as to promote air in the refrigeration compartment 112 and the storage compartment to flow circularly, thereby humidifying the storage compartment.

As for the refrigerating and freezing device 100 of the present invention, the air in the storage compartment is utilized to carry out air defrosting on the refrigeration compartment 112, and then the defrosted high-humidity gas is led back to the storage compartment; the conceptual limitation of the prior art of utilizing a heating device to generate liquid defrosted water and then carrying out humidification is broken through, and heat of the storage compartment is fully utilized to defrost the refrigeration compartment 112; and the air temperature after defrosting is more suitable, and more abundant humidity can be brought to the storage compartment, thereby reducing the production cost and energy consumption during use.

In some embodiments, before the step of controlling the refrigeration system to stop supplying cold to the storage compartment, the processor may be further configured to control the refrigeration system to supply cold to the storage compartment when a storage temperature of the storage compartment is greater than or equal to a preset start-up temperature, and then humidify the storage compartment (i.e., stopping supplying cold to the storage compartment and keeping the fan 130 operating) when the storage temperature of the storage compartment decreases to be less than or equal to a preset shutdown temperature, so as to make the temperature of the storage compartment within an allowable fluctuating range, thereby ensuring the storage quality of food in the storage compartment.

The preset shutdown temperature is greater than 0° C. That is, the temperature of the storage compartment is always kept at 0° C. or above to defrost the refrigeration compartment 112.

In some further embodiments, the processor may be further configured to defrost the refrigeration compartment 112 and humidify the storage compartment (i.e., stopping supplying cold to the storage compartment and keeping the fan 130 operating) each time after the completion of refrigeration of the storage compartment (i.e., when the storage temperature of the storage compartment decreases to be less than or equal to the preset shutdown temperature), so as to avoid excessive frosting of the storage compartment, thereby increasing the effective utilization rate of cold and making the humidity of the storage compartment more stable.

In some embodiments, the storage compartment may be separated by shelf plates 140 and a drawer into a fresh-keeping area 111*b* and a common storage area 111*a*. The fresh-keeping area 111*b* is usually configured to store fruits and vegetables.

In some further embodiments, the processor may be further configured to, when controlling the refrigeration system to supply cold to the storage compartment, connect the refrigeration compartment 112 with the storage area 111*a* and disconnect the refrigeration compartment 112 from the fresh-keeping area 111*b*, so as to avoid the humidity of the fresh-keeping area 111*b* from being reduced. In this embodiment, the storage temperature of the storage compartment is the temperature of the storage area 111*a*. Whether the storage compartment needs to be supplied with cold (when the storage temperature of the storage compartment is greater than or equal to the preset start-up temperature) or whether the supply of cold to the storage compartment is completed (when the storage temperature of the storage compartment is less than or equal to the preset shutdown temperature) is judged according to the temperature of the storage area 111*a*.

The fresh-keeping area 111*b* may be arranged below the storage area 111*a*, so as to supply cold to the fresh-keeping area 111*b* by means of sinking of cold air of the storage area 111*a*.

Figure 2:
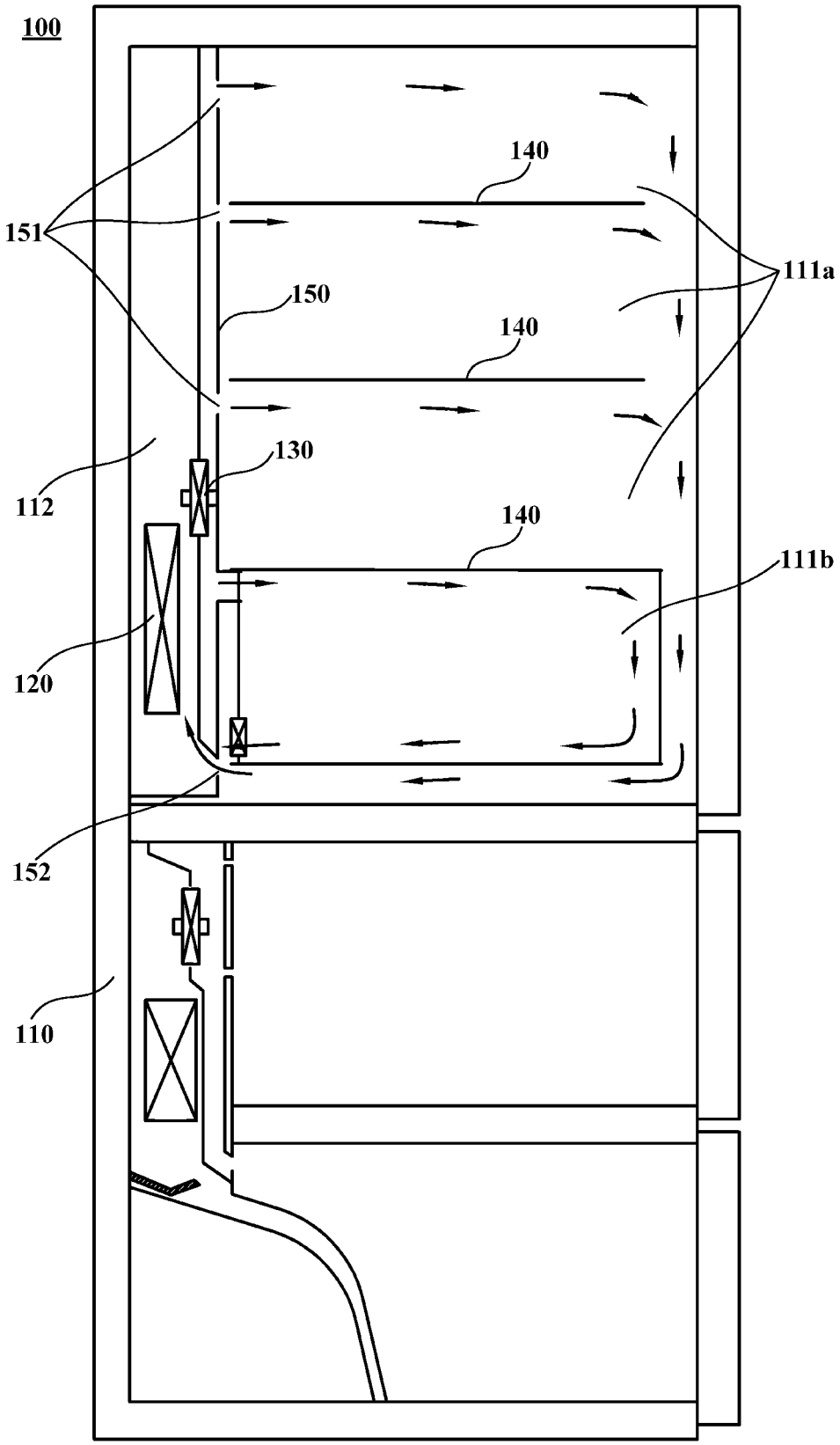
FIG. 2 is a schematic section view of the refrigerating and freezing device shown in FIG. 1, showing a gas flow path that connects the refrigeration compartment with the storage area and the fresh-keeping area.

FIG. 2 is a schematic section view of the refrigerating and freezing device 100 shown in FIG. 1, showing a gas flow path that connects the refrigeration compartment 112 with the storage area 111*a* and the fresh-keeping area 111*b*. Referring to FIG. 1 and FIG. 2, in some further embodiments, the processor may be further configured to connect the refrigeration compartment 112 with the storage area 111*a* firstly after controlling the refrigeration system to stop supplying cold to the storage compartment, and connect the refrigeration compartment 112 with the storage area 111*a* and the fresh-keeping area 111*b* after a first preset time, so as to effectively humidify the fresh-keeping area 111*b* and keep the humidity of the storage area 111*a* stable.

The processor may be further configured to control the fan 130 to stop operating and disconnect the refrigeration compartment 112 from the fresh-keeping area 111*b* (that is, humidification of the fresh-keeping area 111*b* is completed) after connecting the refrigeration compartment 112 with the fresh-keeping area 111*b* for a second preset time, and then disconnect, after disconnecting the refrigeration compartment 112 from the fresh-keeping area 111*b* for a third preset time, the refrigeration compartment 112 from the storage area 111*a*, so as to increase the humidity of the storage area 111*a*.

The fresh-keeping area 111*b* may be provided with a valve 160 for keeping a gas pressure of the fresh-keeping area 111*b* within a preset pressure threshold value to prevent the gas pressure of the fresh-keeping area 111*b* from being too high and causing the drawer to open automatically.

Figure 3:
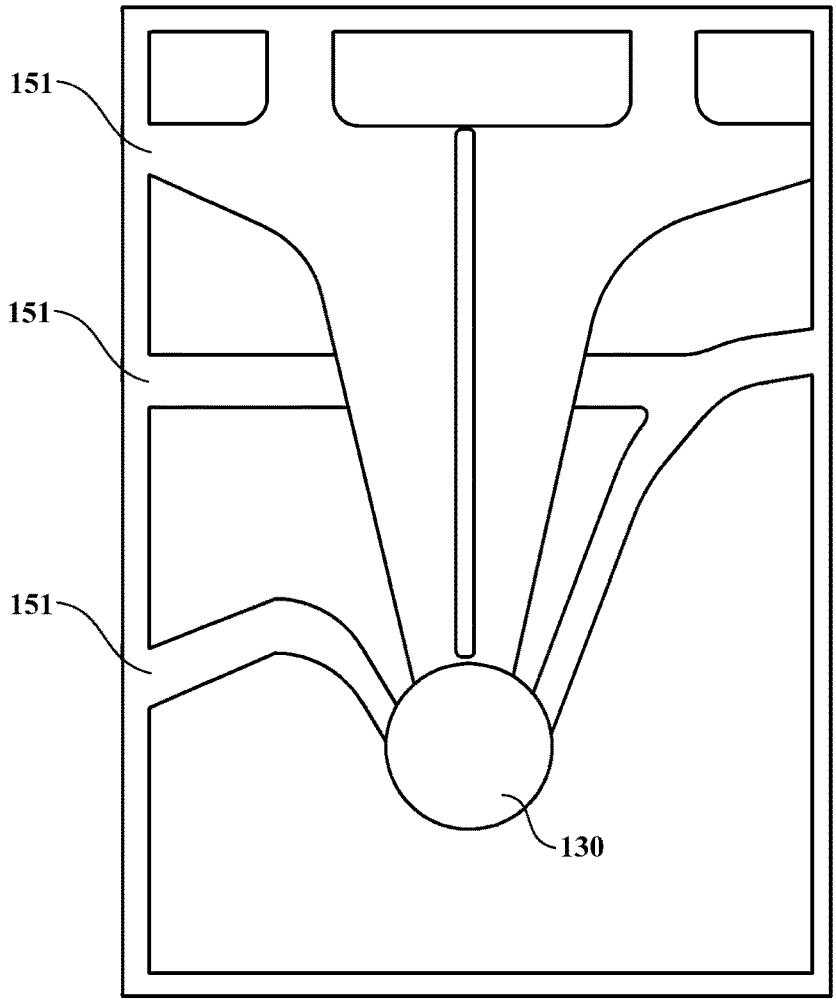
FIG. 3 is a schematic section view of a refrigeration compartment according to an embodiment of the present invention.

FIG. 3 is a schematic section view of a refrigeration compartment 112 according to an embodiment of the present invention. Referring to FIG. 1 to FIG. 3, the air duct cover plate 150 may form a return air inlet 152 and at least one air supply portion. Each air supply portion may be provided with at least one air supply port 151 and an air inlet.

The air supply fan 130 may be arranged downstream of the evaporator 120 and includes a volute and an impeller arranged in the volute. The volute is configured to be rotatable and to make its air outlet to be in butt joint with the air inlet of the one or more air supply portions, so as to convey cold airflow refrigerated by the evaporator 120 to the corresponding air supply portion and blow it out from the air supply port 151 of the air supply portion.

Figure 4:
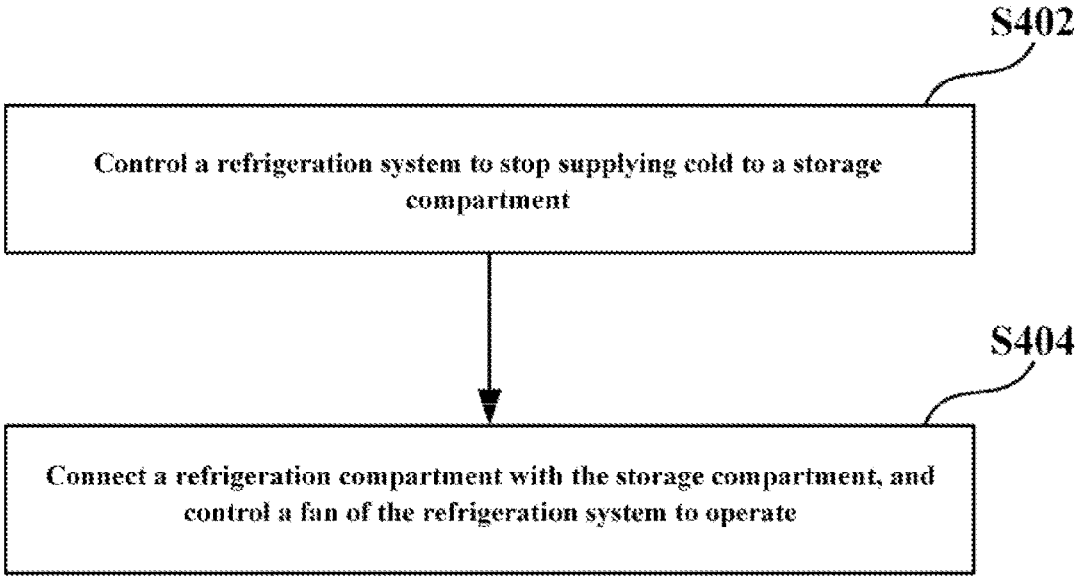
FIG. 4 is a schematic flow chart of a control method for a refrigerating and freezing device according to an embodiment of the present invention.

FIG. 4 is a schematic flow chart of a control method for a refrigerating and freezing device 100 according to an embodiment of the present invention. Referring to FIG. 4, the control method for the refrigerating and freezing device 100 of the present invention may include the following steps.

At step S402, a refrigeration system is controlled to stop supplying cold to a storage compartment.

At step S404, a refrigeration compartment 112 is connected with the storage compartment, and a fan 130 of the refrigeration system is controlled to operate so as to promote air in the refrigeration compartment 112 and the storage compartment to flow circularly, thereby humidifying the storage compartment.

As for the control method of the present invention, the air in the storage compartment is utilized to carry out air defrosting on the refrigeration compartment 112, and then the defrosted high-humidity gas is led back to the storage compartment; the conceptual limitation of the prior art of utilizing a heating device to generate liquid defrosted water and then carrying out humidification is broken through, and heat of the storage compartment is fully utilized to defrost the refrigeration compartment 112; and the air temperature after defrosting is more suitable, and more abundant humidity can be brought to the storage compartment, thereby reducing the production cost and energy consumption during use.

In some embodiments, before step S402, the control method of the present invention may also include the following step:

controlling, when the storage temperature of the storage compartment is greater than or equal to a preset start-up temperature, the refrigeration system to supply cold to the storage compartment.

Further, when the storage temperature of the storage compartment decreases to be less than or equal to a preset shutdown temperature, step S402 is performed, so as to make the temperature of the storage compartment within an allowable fluctuating range, thereby ensuring the storage quality of food in the storage compartment.

In the present invention, the storage temperature of the storage compartment is the temperature of the storage area

111*a*. Whether the storage compartment needs to be supplied with cold (when the storage temperature of the storage compartment is greater than or equal to the preset start-up temperature) or whether the supply of cold to the storage compartment is completed (when the storage temperature of the storage compartment is less than or equal to the preset shutdown temperature) is judged according to the temperature of the storage area 111*a*.

The preset shutdown temperature is greater than 0° C. That is, the temperature of the storage compartment is always kept at 0° C. or above to defrost the refrigeration compartment 112.

In some further embodiments, the refrigeration compartment 112 is connected with the storage area 111*a* and disconnected from the fresh-keeping area 111*b* while the refrigeration system is controlled to supply cold to the storage compartment, so as to avoid the humidity of the fresh-keeping area 111*b* from being reduced.

In some further embodiments, step S402 is performed each time the storage temperature of the storage compartment decreases to be less than or equal to the preset shutdown temperature, so as to avoid excessive frosting of the storage compartment, thereby increasing the effective utilization rate of cold and making the humidity of the storage compartment more stable.

In some embodiments, step S404 may further include the following steps:

connecting the refrigeration compartment 112 with the storage area 111*a*; and connecting the refrigeration compartment 112 with the storage area 111*a* and the fresh-keeping area 111*b* to humidify the fresh-keeping area 111*b* after a first preset time, so as to effectively humidify the fresh-keeping area 111*b* and keep the humidity of the storage area 111*a* stable.

In some further embodiments, the control method of the present invention may also include the following steps:

controlling the fan 130 to stop operating and disconnecting the refrigeration compartment 112 from the fresh-keeping area 111*b* after performing the step of connecting the refrigeration compartment 112 with the storage area 111*a* and the fresh-keeping area 111*b* for a second preset time; and disconnecting, after a third preset time, the refrigeration compartment 112 from the storage area 111*a*, so as to increase the humidity of the storage area 111*a*.

Figure 5:
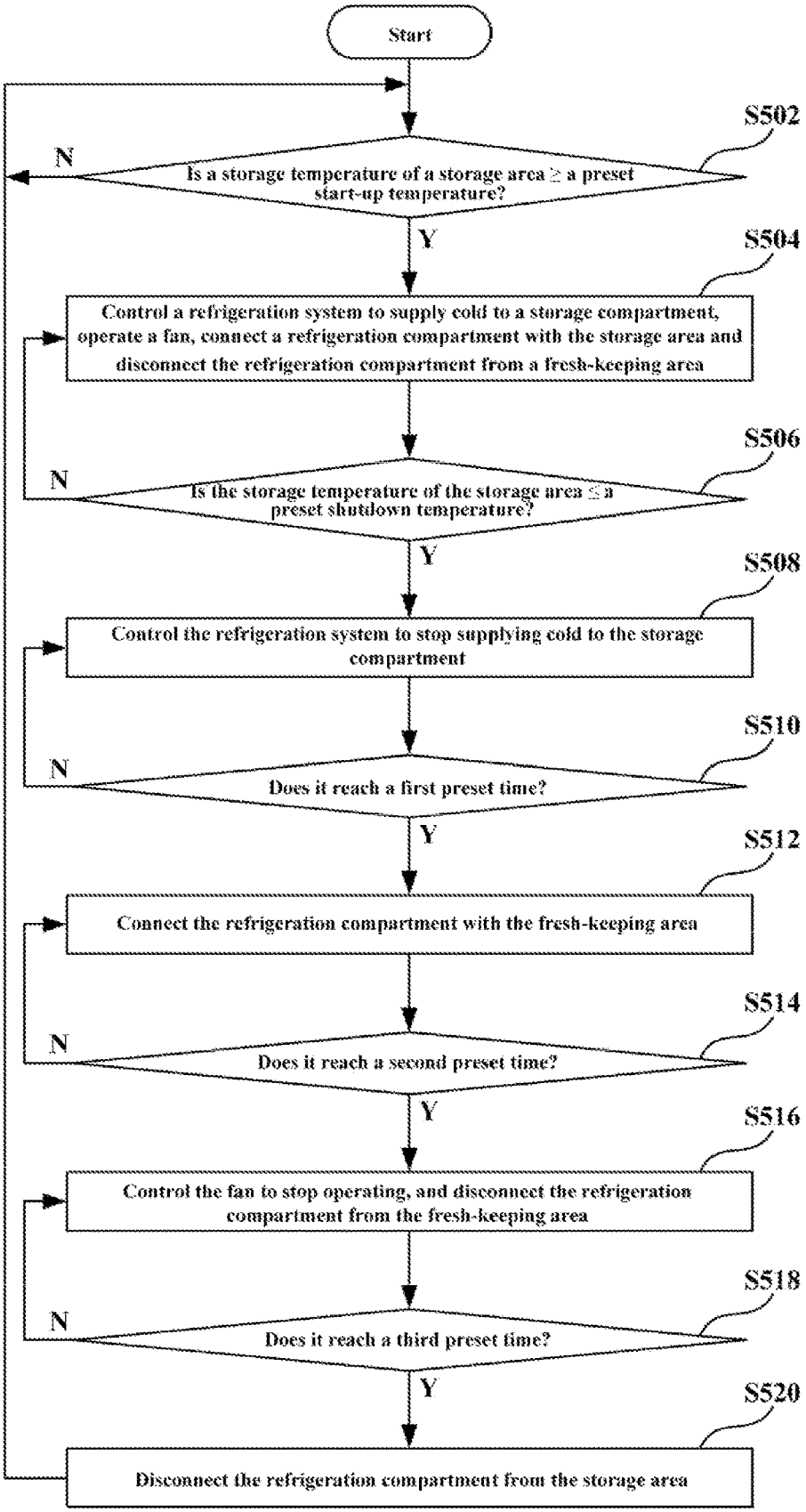
FIG. 5 is a schematic detailed flow chart of a control method for a refrigerating and freezing device according to an embodiment of the present invention.

FIG. 5 is a schematic detailed flow chart of a control method for the refrigerating and freezing device 100 according to an embodiment of the present invention (where "Y" represents "Yes"; and "N" represents "No"). Referring to FIG. 5, the control method for the refrigerating and freezing device 100 of the present invention may include the following detailed steps.

At step S502, whether a storage temperature of the storage compartment is greater than or equal to the preset start-up temperature is judged. If yes, step S504 is performed; and if not, step S502 is repeated.

At step S504, the refrigeration system is controlled to supply cold to the storage compartment, the fan 130 operates, and the refrigeration compartment 112 is connected with the storage area 111*a* and disconnected from the fresh-keeping area 111*b*.

At step S506, whether the storage temperature of the storage compartment decreases to be less than or equal to the preset shutdown temperature is judged. If yes, step S508 is performed; and if not, it returns to step S504.

At step S508, the refrigeration system is controlled to stop supplying cold to the storage compartment, the fan 130 continues to operate, and the refrigeration compartment 112 continues to be connected with the storage area 111*a* and disconnected from the fresh-keeping area 111*b*.

At step S510, whether the operation time of step S508 reaches a first preset time is judged. If yes, step S512 is performed; and if not, it returns to step S508.

At step S512, the refrigeration compartment 112 is connected with the fresh-keeping area 111*b* and continues to be connected with the storage area 111*a*.

At step S514, whether the operation time of step S512 reaches a second preset time is judged. If yes, step S516 is performed; and if not, it returns to step S512.

At S516, the fan 130 is controlled to stop operating, and the refrigeration compartment 112 is disconnected from the fresh-keeping area 111*b* and continues to be connected with the storage area 111*a*.

At step S518, whether the operation time of step S516 reaches a third preset time. If yes, step S520 is performed; and if not, it returns to step S516.

At step S520, the refrigeration compartment 112 is disconnected from the storage area 111*a*. And it returns to step S502.

At this point, it should be recognized by those skilled in the art that, although multiple exemplary embodiments of the present invention have been exhaustively shown and described herein, many other variations or modifications in accordance with the principles of the present invention may still be directly determined or derived from the disclosure of the present invention without departing from the spirit and scope of the present invention. Therefore, the scope of the present invention should be understood and recognized as covering all these other variations or modifications.

The invention claimed is:

1. A control method for a refrigerating and freezing device, the refrigerating and freezing device comprising a storage compartment, a refrigeration compartment, and a refrigeration system at least partially arranged in the refrigeration compartment, and the storage compartment being separated into a fresh-keeping area and a common storage area, wherein the control method comprises:

controlling the refrigeration system to stop supplying cold to the storage compartment; and after the refrigeration system stops supplying cold to the storage compartment, connecting the refrigeration compartment with the storage compartment, and controlling a fan of the refrigeration system to operate so as to promote air in the refrigeration compartment and the storage compartment to flow circularly, and wherein connecting the refrigeration compartment with the storage compartment comprises:

first connecting the refrigeration compartment with the storage area; and after the refrigeration compartment has been connected with the storage area for a first preset time, then connecting the refrigeration compartment with both the storage area and the fresh-keeping area to humidify the fresh-keeping area.

2. The control method according to claim 1, further comprising:

controlling the fan to stop operating and disconnecting the refrigeration compartment from the fresh-keeping area after performing the step of connecting the refrigeration compartment with the storage area and the fresh-keeping area for a second preset time; and after the refrigeration compartment has been disconnected from the fresh-keeping area for a third preset time, disconnecting the refrigeration compartment from the storage area.

3. The control method according to claim 1, before the step of controlling the refrigeration system to stop supplying cold to the storage compartment, further comprising:

controlling, when a storage temperature of the storage compartment is greater than or equal to a preset start-up temperature, the refrigeration system to supply cold to the storage compartment; and performing, when the storage temperature of the storage compartment decreases to be less than or equal to a preset shutdown temperature, the step of controlling the refrigeration system to stop supplying cold to the storage compartment.

4. The control method according to claim 3, wherein the storage temperature of the storage compartment is the temperature of the storage area; and/or wherein the storage temperature of the storage compartment is greater than 0° C.

5. The control method according to claim 3, wherein while performing the step of controlling the refrigeration system to supply cold to the storage compartment, the control method further comprises:

connecting the refrigeration compartment with the storage area, and disconnecting the refrigeration compartment from the fresh-keeping area.

6. The control method according to claim 3, wherein the step of controlling the refrigeration system to stop supplying cold to the storage compartment is performed each time the storage temperature of the storage compartment decreases to be less than or equal to the preset shutdown temperature.

7. A refrigerating and freezing device, comprising:

a cabinet, defining a storage compartment and a refrigeration compartment;

a refrigeration system, at least partially arranged in the refrigeration compartment to supply cold to the storage compartment;

a processor; and a memory, storing a computer program which, when executed by the processor, is used to implement the control method according to claim 1.

8. The refrigerating and freezing device according to claim 7, wherein the storage compartment is separated into a fresh-keeping area and a common storage area; and the fresh-keeping area is arranged below the storage area.

9. The refrigerating and freezing device according to claim 7, wherein the storage compartment is separated into a fresh-keeping area and a common storage area; and the fresh-keeping area is provided with a valve for keeping a gas pressure of the fresh-keeping area within a preset pressure threshold value.

* * * * *